United States Patent [19]

Brock

[11] 4,336,829

[45] Jun. 29, 1982

[54] DOBBY MECHANISM

[75] Inventor: Josef Brock, Viersen, Fed. Rep. of Germany

[73] Assignee: Maschinenfabrik Carl Zangs Aktiengesellschaft, Krefeld, Fed. Rep. of Germany

[21] Appl. No.: 77,887

[22] Filed: Sep. 21, 1979

[30] Foreign Application Priority Data

Sep. 22, 1978 [DE] Fed. Rep. of Germany ..... 2841280

[51] Int. Cl.[3] ..... D03C 1/12

[52] U.S. Cl. ..... 139/76

[58] Field of Search ..... 139/76, 77, 66 R, 67, 139/68, 69, 70, 71, 72, 73, 74

[56] References Cited

U.S. PATENT DOCUMENTS

| | | | |
|---|---|---|---|
| 3,724,511 | 4/1973 | Kleiner | 139/66 R |
| 3,804,128 | 4/1974 | Amigues | 139/66 R |

FOREIGN PATENT DOCUMENTS

| | | | |
|---|---|---|---|
| 1328667 | 4/1963 | France | 139/66 R |
| 320577 | 1/1972 | U.S.S.R. | 139/66 R |

*Primary Examiner*—Henry Jaudon
*Attorney, Agent, or Firm*—Martin A. Farber

[57] ABSTRACT

A dobby mechanism with a coupling, controlled according to a design, between a stationary drive shaft and a first gear with the number of teeth n, which first gear meshes with a second gear with the number of teeth 2n on a stationary axle, on which second gear an eccentric device for the dobby movement is arranged, whereby the drive shaft and the first gear are coupleable with each other by means of a radially movably mounted wedge, which wedge is controlled with a switching member from the outside according to a design, and in the coupled condition partially engages in a radially extending recess of the first gear and partially in an axially extending groove of the drive shaft. In the uncoupled condition the wedge is completely uncoupled from the drive shaft and the switching member comprises a switching rod, the latter being controlled according to the design, the switching rod in the coupling range engaging with a coupling member in a groove of the wedge.

9 Claims, 12 Drawing Figures

DOBBY MECHANISM

Figure 1:
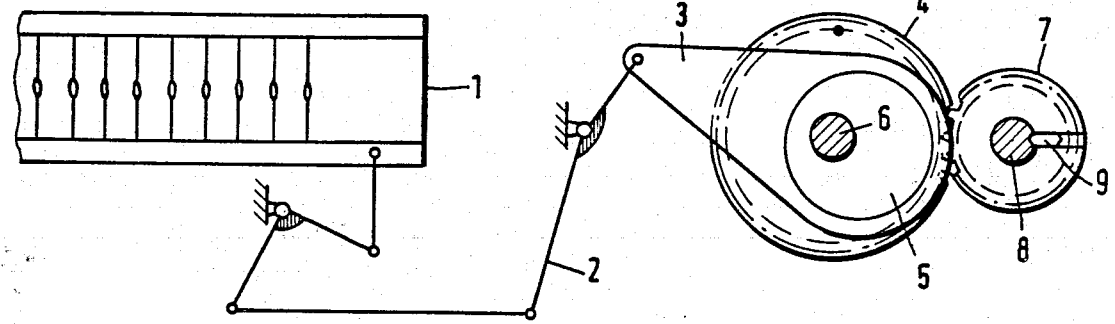

The invention relates to a dobby mechanism with a coupling (which coupling is controlled according to a design or pattern) between a stationary drive shaft and a first gear with the number of teeth n, which first gear meshes with a second gear with the number of teeth 2n on a stationary axle, on which second gear an eccentric device for the dobby movement is arranged, whereby the drive shaft and the first gear are coupleable with each other by means of a radially movably mounted wedge, which wedge is controlled with a switching member from the outside according to a design, and in the coupled condition partially engages in a radially extending recess of the first gear and partially in an axially extending groove of the drive shaft.

Dobby mechanisms with a reduction or step-down gear between the drive shaft and the eccentric device for the dobby movement as well as a wedge- or vee-coupling between the drive shaft and the reduction gearing (the wedge coupling being controlled according to a design or pattern) are known from the German Pat. No. 957,648 of Nov. 25 1952. With this known dobby mechanism the wedge is moved with a switching or control lever that is controlled according to a pattern, and in the uncoupled condition the wedge lies completely in an axially extending groove of the drive shaft. The control according to a design of the switching lever takes place in this operation by means of a card drum or cylinder, the card drum being complemented or equipped with stroke or lifting bodies, which bodies move the switching lever. These known shaft machines are no longer useable for the speeds that are required nowadays with textile or weaving machines, because the wedge can be moved with the switch or control lever only when the drive shaft stands still or is stationary, so that valuable time is lost for the reversal, and the maximum or highest possible rotational speed of the textile machine or weaving loom is limited.

From the German Pat Nos. 2,036,643 of Dec. 9, 1971, and 2,036,644 of Dec. 9, 1971 a rotation shaft machine for high speed weaving textile loom machines is known in which the shafts likewise are actuated by means of an eccentric device with a wedge coupling, whereby the eccentric or cam for the dobby movement and the wedge coupling are arranged directly on the drive shaft. With this known dobby, an up and down movement of the shaft corresponds to one complete rotation of the drive shaft. Since, however, thhe dobbies as a rule are intended to come to a stop after an upward or a downward movement, that is to say after one-half rotation of the drive shaft, the wedge coupling must be actuatable or it must be able to be actuated in two diametrically opposite positions of the drive shaft. For this, comparatively complicated devices are required.

It is the object of the invention to construct a dobby mechanism of the type described in the introduction, with which a reduction gear is arranged between the drive shaft and the eccentric device for the movement of the dobbies, whereby one-half a rotation of the eccentric corresponds to one complete rotation of the drive shaft such that the switching times for the wedge can be considerably shortened and a stopping of the drive shaft is no longer absolutely required for an orderly or proper coupling operation.

This object is aided in solution in the manner that in the uncoupled condition the wedge is completely uncoupled from the drive shaft and the switching member comprises a switching rod (the rod being controlled according to a design), the switching rod in the coupling range engaging with a coupling member (16) in a groove of the wedge. A ring (24) is provided which cooperates with the wedge.

To start with, a dobby mechanism formed according to the invention has the advantage that with coupling or uncoupling of the wedge a stopping of the drive shaft is no longer absolutely required and that even when a short stopping of the drive shaft is provided, the coupling and uncoupling times are much shorter than with the known dobby mechanism. In addition, with a dobby machine formed according to the invention, it is no longer necessary for all wedges to be actuated, but rather only the wedges that are coordinated or associated with a dobby which should be moved from the bottom shed to the upper shed or in the reverse order. This is because the wedges are no longer uncoupled in a position completely pressed into the axial groove of the drive shaft but are uncoupled in a position removed from the groove of the drive shaft.

Although the wedge in the uncoupled condition is held secure by the coupling member of the switching rod and in the connected condition is clamped-in between the drive shaft and the eccentric device, with a dobby mechanism according to the invention, the ring can be mounted on the gear which gear is connected with the drive shaft, the ring having a slot in the coupling range, in which slot in the coupling range the wedge engages in the uncoupled condition with its outer end, and beneath an over lapping annular projection of the ring the wedge is guided in the coupled condition. For the situation of a faulty connection or control, the ring is mounted rotatably and at its periphery has a detent, which detent can comprise a spring-loaded, radially moveably blocking wedge, or also can comprise an adjustable sliding or slip clutch.

The wedge suitably engages with an attachment or shoulder in the recess of the toothed gear wheel, which gear is mounted on the drive shaft, the attachment having a blind end bore for the reception of a spring. The spring has the task of pressing the wedge, after the coupling during its rotation, into the groove of the drive shaft and additionally holding it secure in its coupled condition. In another embodiment the previously described ring is not required. For the arresting of the wedge in the uncoupled position, a resiliently mounted pawl latch or catch can be provided, in which latch the wedge engages or catches-in with its outer end.

Furthermore it has proven advantageous to guide the switching rod with an oblong or slotted hole on a pin or peg of a stationary guide ring. Finally, the ends of the coupling member as well as the entrances of the groove or slot of the wedge can be beveled in order to achieve a smooth or gentle coupling and uncoupling with a continuously running drive shaft.

With weaving machines it is frequently desired or demanded that for the adjustment of the shafts or for other operations all the dobbies can be brought simultaneously into a midposition between the bottom shed and the upper shed. With the known dobby mechanisms with an eccentric device this causes considerable difficulties because of the two diametrically opposite coupling positions. With a dobby mechanism designed according to the invention, on the other hand, it suffices to provide an arrangement with which all switching rods can be shifted into the coupled position. Then if the drive shaft is turned by one half a rotation, all the dobbies are in their midposition.

Figure 2:
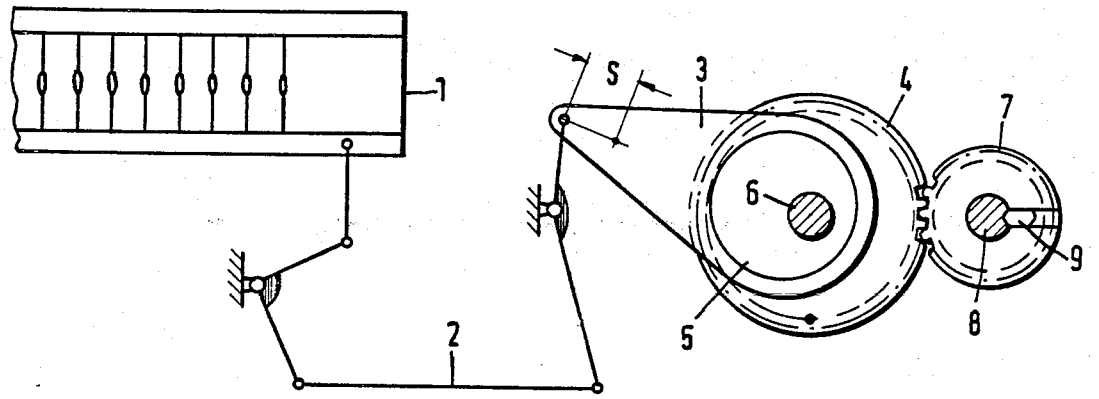
Figure 4:
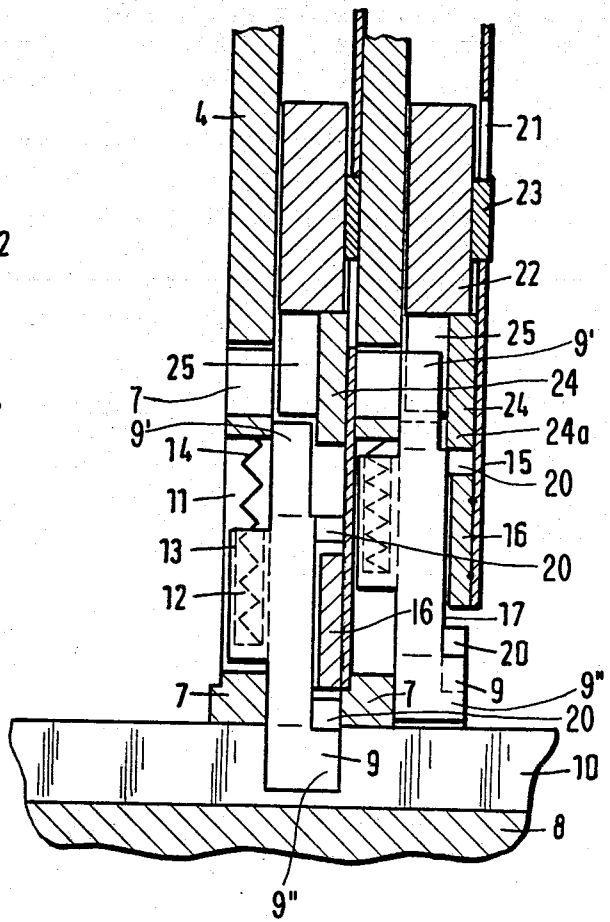
Figure 3:
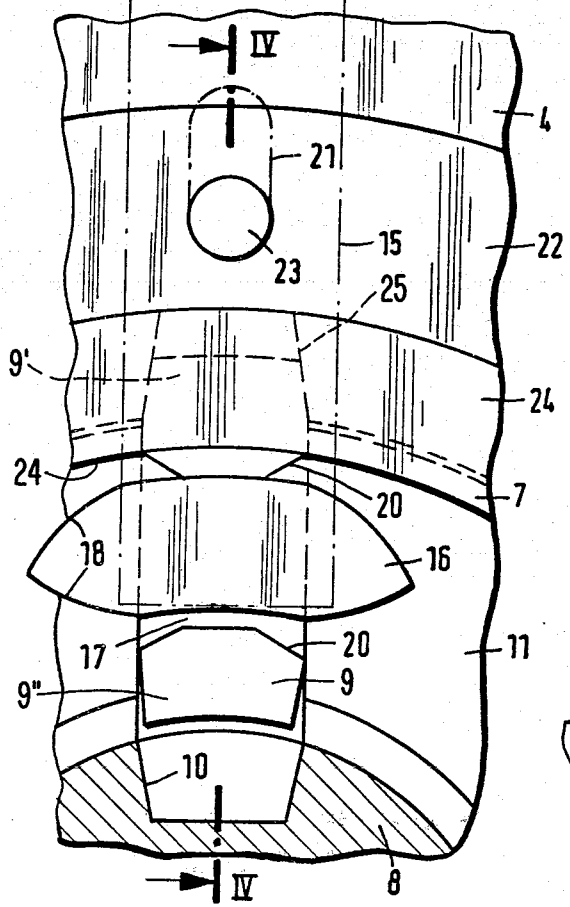
Figure 3A:
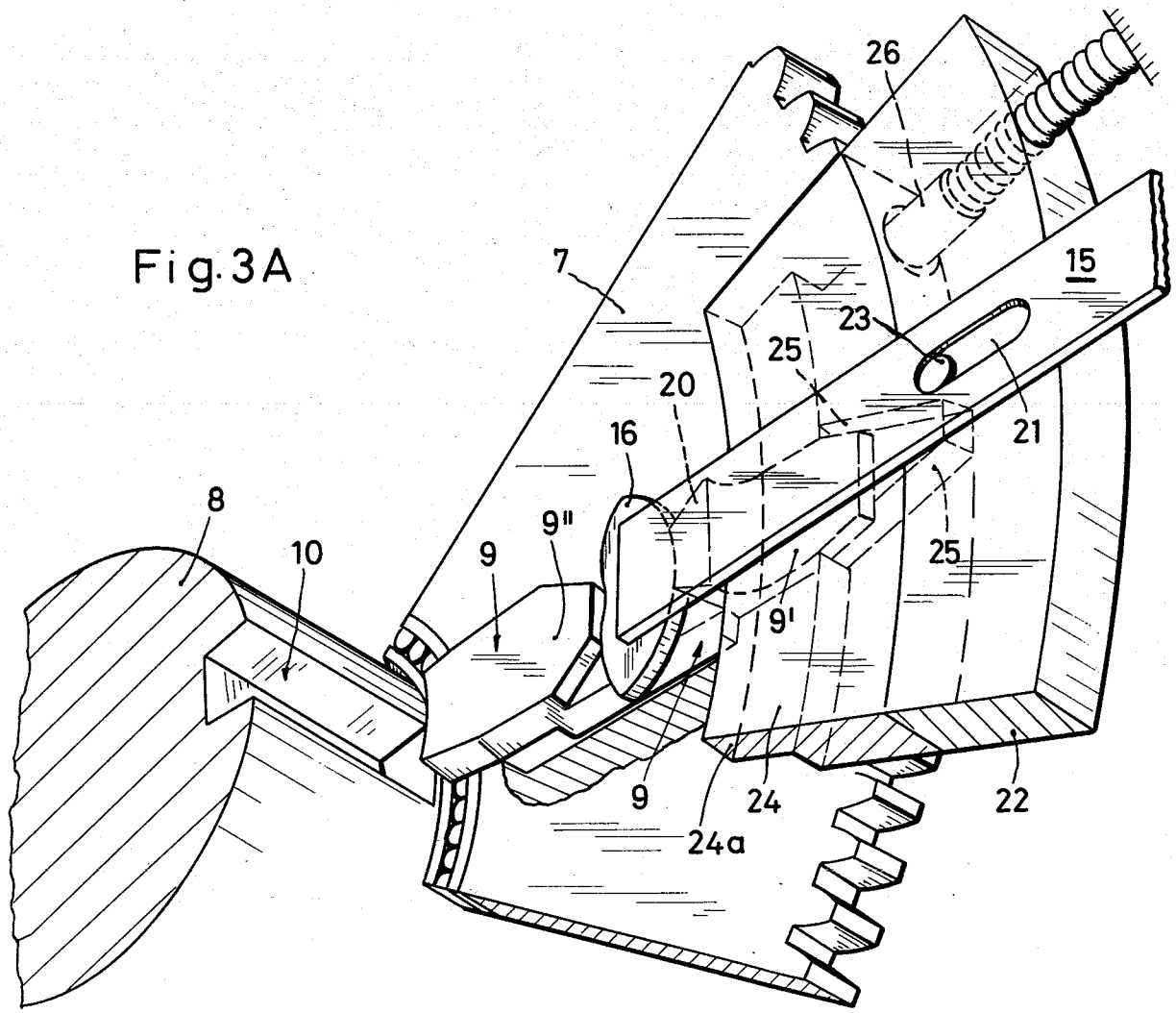
Figure 5:
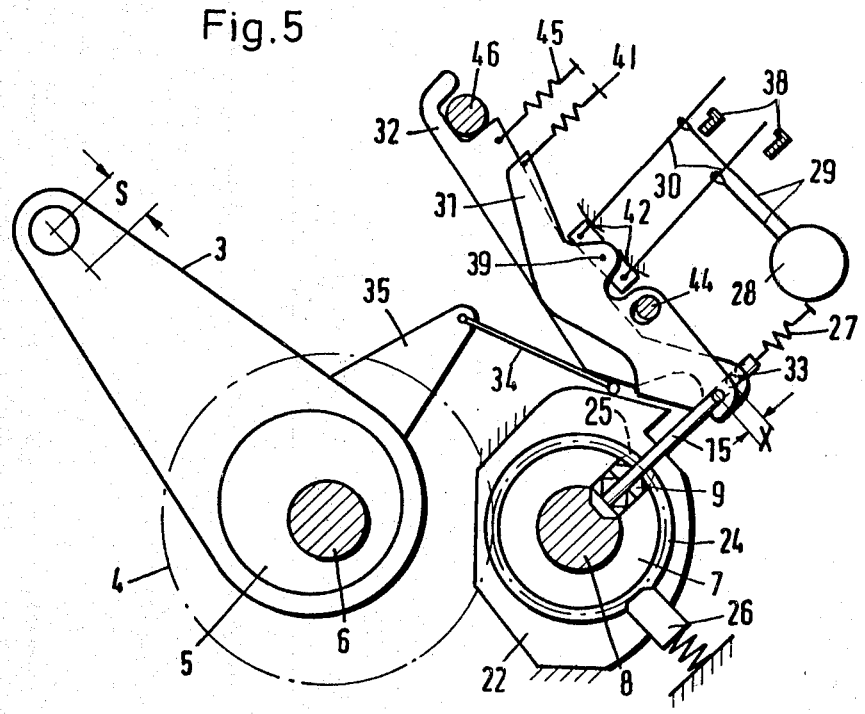
Figure 5A:
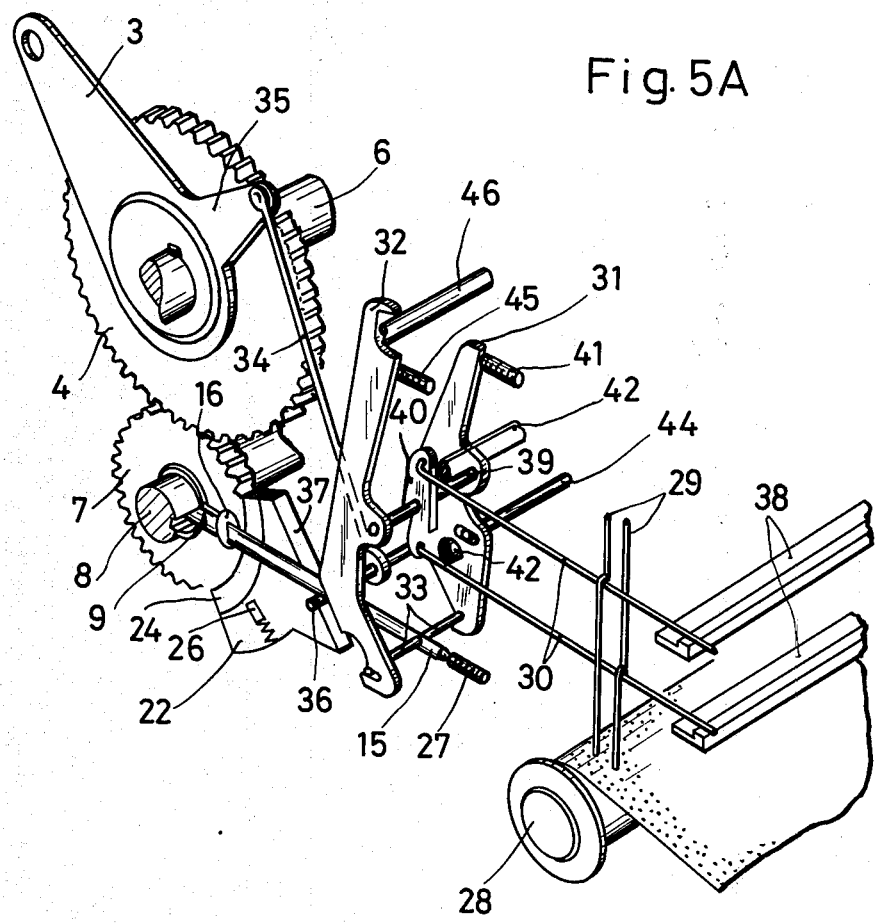
Figure 9:
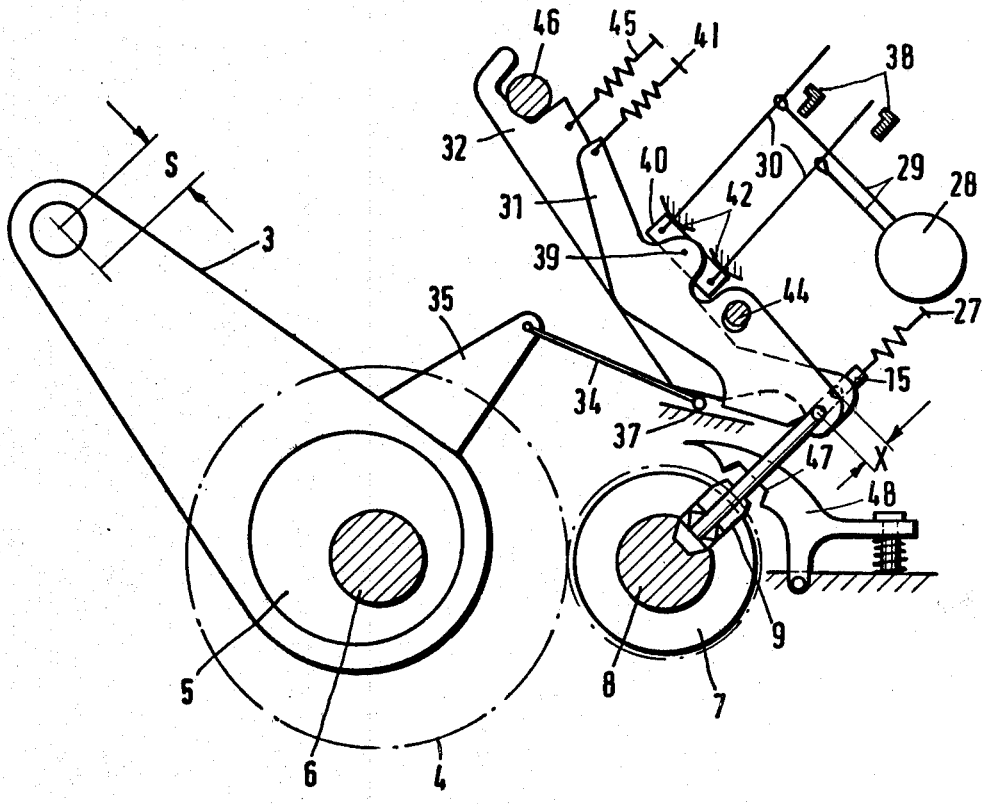
Figure 10:
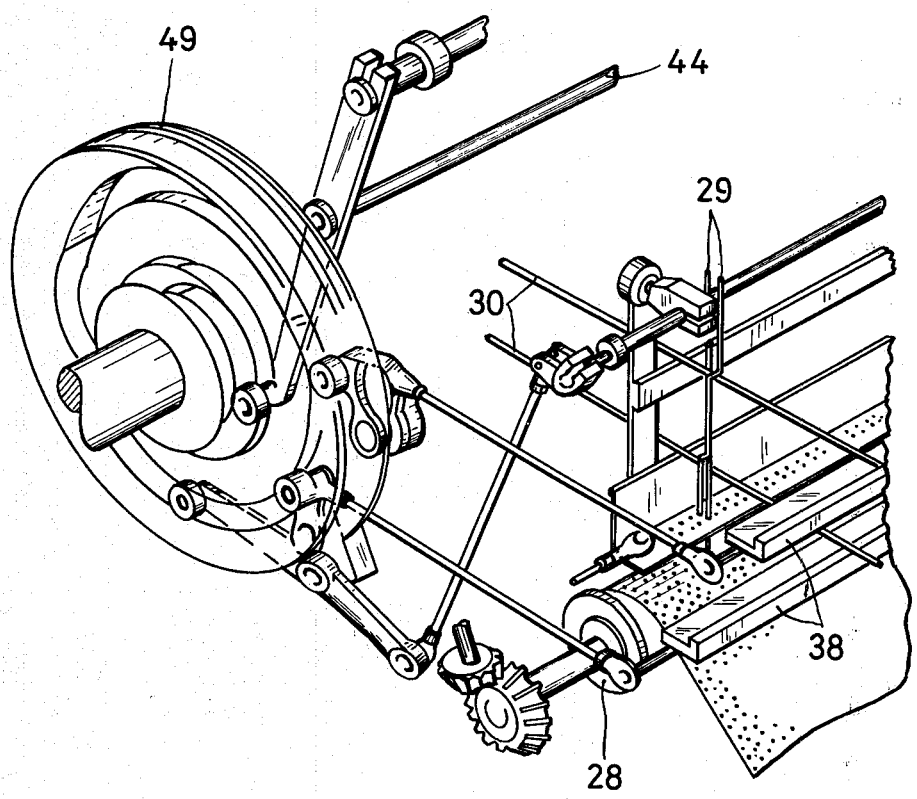

Further details, characteristics and advantages of a dobby mechanism according to the invention will be seen in the herebelow description of the accompanying drawing, in which a preferred embodiment is shown in top views and sections. In the drawings are shown:

FIG. 1 a schematic illustration of a dobby in the bottom shed position and of its drive;

FIG. 2 a schematic illustration of a dobby in the upper shed position and of its drive;

FIG. 3 a side view of a wedge coupling;

FIG. 3A is a perspective view of the wedge coupling according to FIG. 3;

FIG. 4 the same wedge coupling sectioned along the line IV—IV in FIG. 3, and specifically with one wedge in the coupled condition and another wedge in the uncoupled condition;

FIGS. 5–8 schematic illustrations of the eccentric device with drive and control in four different coupling-, and respectively, control-positions;

FIG. 5A is a perspective schematic illustration of the eccentric device according to FIG. 5;

FIG. 9 a schematic illustration of another embodiment example with pawl latch or catch for the wedge in the uncoupled position of the latter;

FIG. 10 is a perspective view of a drive device for the pressing rails of the needle mechanism and a moveable control axle for the wedge coupling.

A dobby 11 is connected with a connecting rod 3 via a transmission or gearing 2, which gearing 2 is mounted on an eccentric disc 5, the disc 5 being secured to a toothed wheel or gear 4. The gear 4 and the eccentric disc 5 are secured on an axle 6.

An additional toothed wheel or gear 7 meshes with the gear 4, the gear 7 being mounted relatively rotably mounted on a drive shaft 8. The diametical pitches of the gears 4 and 7 have a relationship of 2:1 so that one half a rotation of the gear 4 corresponds to a complete rotation of the gear 7. Through a complete rotation of the gear 7 the connecting rod 3 is moved from its bottom shed position shown in FIG. 1 by the path s into the upper shed position shown in FIG. 2, or respectively, is moved from the upper shed position again into the bottom shed position.

The gear 7 and the drive shaft 8 can be coupled with each other by means of a wedge 9. For this purpose the drive shaft 8 has a groove or keyway 10 that extends in the axial direction. Whereas the gear 7 has a recess 11 extending in a radial direction, the wedge 9 with a shoulder or attachment 12 engaging in the recess 11. The attachment 12 is provided with a blind hole 13 into which blind hole 13 a spring 14 is inserted the outer end of the spring being mounted in the gear 7. During a rotation the spring 14 holds the wedge 9 secure in its position of being coupled into the drive shaft 8.

The movement of the wedge 9 takes place by means of a switching rod 15 which at the end has a coupling member 16. which coupling engages in a groove or slot 17 of the wedge 9 formed by and between radially outer portion 9' and inner portion 9'' of the wedge. The ends of the coupling member 16 are provided with cams 18, whereas the entrances and outlets of the slot 17 of the wedge 9 have inclined surfaces 20. The switching rod 15 is guided with the longitudinal hole 21 on a peg 23, the peg 23 being secured to a stationary guide ring 22.

A ring 24 is rotatably mounted in the guide ring 22, the ring 24 being formed with a slot 25 in the coupling range for the wedge 9, the slot extending in the radial direction. In the uncoupled condition the wedge engages with its outer-lying end 9' in the slot 25. The ring 24 with an overlapping radially inwardly directed annular projection **24*a* overlaps the wedge 9** even still in the coupled condition, so that the latter during its rotation is secured against or prevented from displacements in the axial direction.

At the outer periphery of the ring 24 a detent is provided, which detent comprises a spring-biased, radially moveable stop or blocking wedge 26, so that in case of a faulty connection or control when the wedge 9 projects partially into the groove 10 of the drive shaft and partially also still into the slot 25 of the ring 24, the ring 24 can rotate therealong.

The control of the switching rod 15, which rod 15 is pulled by a tension spring 27 into its starting position, occurs according to a pattern or design by a card cylinder 28 by means of sensing needles 29, pressing needles 30 and two control levers 31, 32, the latter engaging or acting upon pin 33, which pin is connected with the switching rod 15. No hole in the card—not shown in the drawing—which card is moved by the card cylinder 28 and scanned by the scanning needles 29 signifies that the coordinated dobby 1 is intended to be moved from the upper shed to the bottom shed or to remain in the bottom shed, whereas a hole in the card signifies that the associated dobby 1 is intended to be moved from the bottom shed to the upper shed or to remain in the upper shed.

The control levers 31, 32 receive from a pulse link or member 34 the information as to whether a dobby 1 is situated in the upper shed or in the bottom shed, the pulse member 34 being moved synchroneously with the eccentric device. The pulse member 34 is articulated on a lever 35 (the lever 35 being connected with the connecting rod 3) and with a cylinder or roller 36 slides along on a cam 37, which cam is arranged on the stationary guide ring 22. The two control levers 31 and 32 can be blocked in their starting position by the roller 36 of the pulse member 34.

The function of the control for the coupling and uncoupling of the wedge 9 is very simple: In the drawing in FIG. 5 the associated or coordinated dobby 1 is in the upper shed. The two scanning needles have found no hole in the card and therewith supply the information that the dobby 1 should be moved into the bottom shed. The pressing needles 30 are not pressed or driven out by their sliding rails or pressure guides 38, so that a balance lever 40, which with a pivot axle 39 is mounted on the control lever 31, is drawn by a tension spring 41 toward the balance lever's limit stop or abutment 42. Since however the control lever 31 with a slotted hole 43 is arranged on a control axle 44 (the control axle being moveable synchroneously with the shaft machine), the control lever is swung around its pivot axle 39 so that on the pin 33 of the switching rod 15 a coupling path x is produced and the wedge 9 is connected. The drive shaft 8 takes the connected wedge 9 along therewith and, by means of the step-down gearing, the latter comprising toothed gears 4 and 7, moves the eccentric disc 5 by 180°, so that the associated dobby 1 is moved from the upper shed to the bottom shed.

Figure 6:
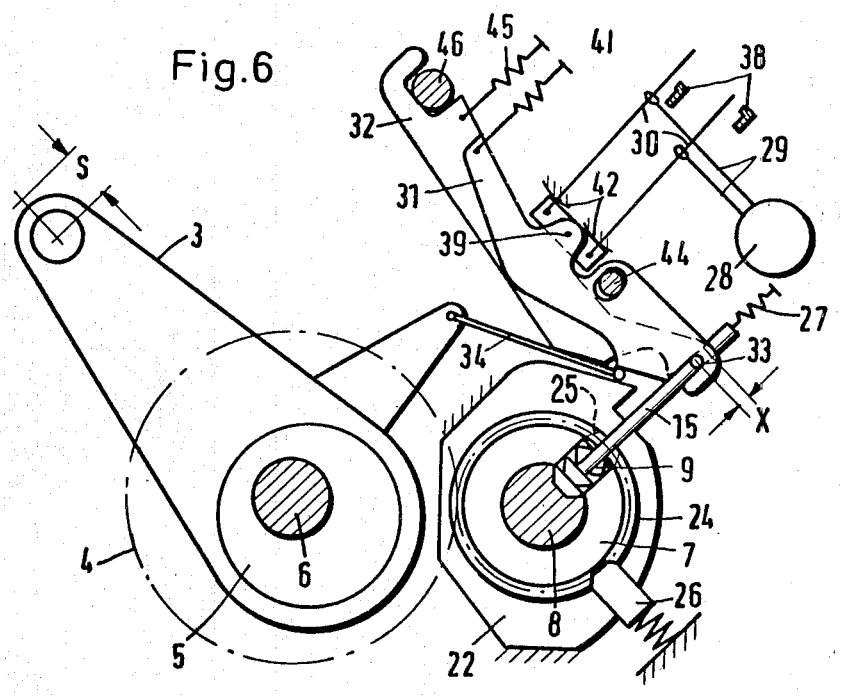

At the end of one rotation of the drive shaft 8 by 360° the control is in the position shown in FIG. 6, in which position the wedge 9 already has been uncoupled again by the switching rod 15 under the effect of the tension spring 27. Simultaneously the roller 36 on the pulse member 34 has been pushed under the control lever 31 by the lever 35, the latter being secured on the connecting rod 3, so that also the control lever 31 is again in its starting position.

Figure 7:
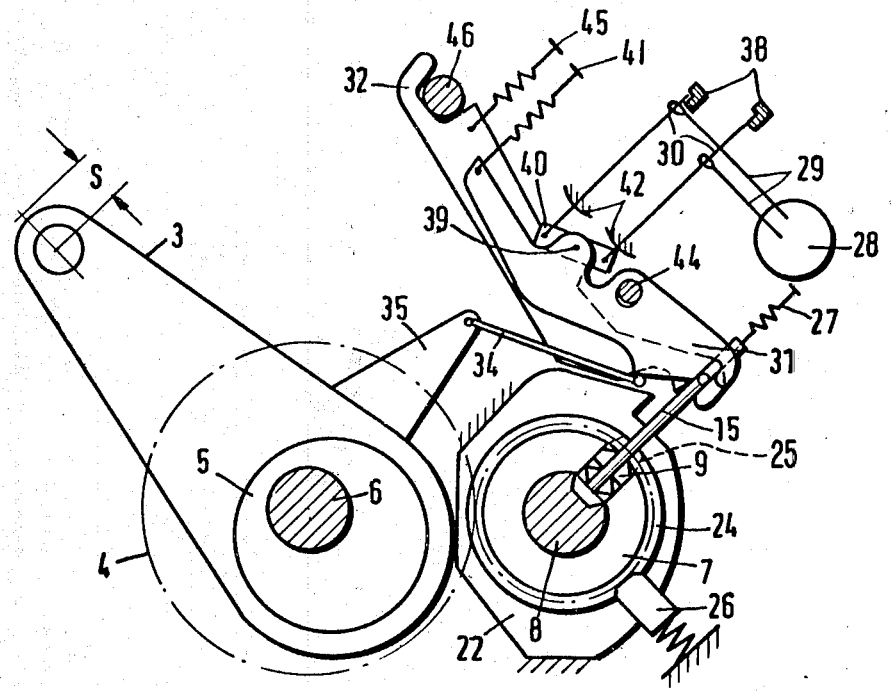

With the control position shown in FIG. 7, the sensing needles 29 have found a hole in the card so that the pressure needles 30 are pressed or driven out. While the control end of the control lever 31 is blocked in its starting position by the pulse member 34, the control lever 32 with its control end is able to make the coupling path x and to connect the wedge 9. In so doing the control lever 32 is drawn by its tension spring 45 against a stop or abutment 46.

Figure 8:
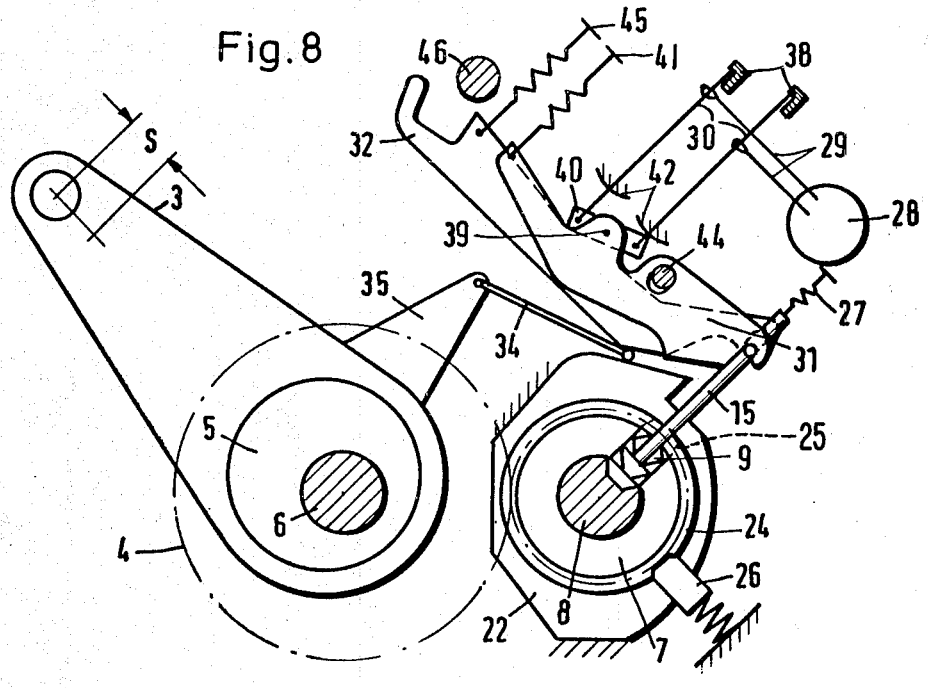

The control position at the end of the shaft movement from the bottom shed to the upper shed is shown in FIG. 8. The wedge 9 is uncoupled from the drive shaft 8 because the tension spring 45 has pivoted the control lever 32 around its pivot axle 39 and the pulse member 34 has blocked the control lever 32, so that the tension spring 27 was able to pull the switching member 15 back into its starting position. As soon as the pressure guides 38 are lifted off from the pressing needles 30, all the parts of the control again move into the starting position shown in FIG. 5 before the coupling-in of the wedge 9.

The drive device for both pressure guides 38 and the moveable control axle 44 is seen in FIG. 10. It is a separate cam disc 49 which is driven by the weaving machine, from which the movement pulses for the pressure guides 38 and the movable control axle 44 can be taken off.

In FIG. 9 there is shown a preferred embodiment without the guide ring 22 and the ring 24. With this embodiment the uncoupled wedge 9 engages or catches in a recess 47 of a resiliently mounted pawl, latch or detent 48. Otherwise, the functions or performances of the drive and the control have remained unchanged.

All the new features mentioned in the descriptions and shown in the drawings are essential to the invention, including insofar as they have not been explicitly claimed in the claims.

I claim:

1. A dobby mechanism having a design controlled coupling between a drive shaft and a first gear with the number of teeth n, which first gear meshes with a second gear with the number of teeth 2n on an axle, on which second gear an eccentric device for the dobby movement is arranged, whereby the drive shaft and the first gear are coupleable with each other by means of a wedge radially movably mounted in a radially extending recess of the first gear, which wedge is controlled through a switching member according to said design, and in the coupled condition engages in said radially extending recess of the first gear and in an axially extending groove of the drive shaft, the improvement wherein in the uncoupled condition the wedge is completely uncoupled from the drive shaft, the switching member includes a switching rod, said switching rod being controlled according to the design, said switching rod further includes a coupling member, said wedge is formed with a groove in which said coupling member of said switching rod engages in a coupling range, a ring having a slot and a radially inwardly directed overlapping portion, said wedge has an outer end, said outer end engages in said slot of said ring in the uncoupled condition of the wedge from the drive shaft, said outer end is constrained by said radially inwardly directed overlapping portion overlapping said wedge adjacent said outer end in the coupled condition and uncoupled condition, respectively, of said wedge.

2. A dobby mechanism having a coupling between a drive shaft and a first gear with the number of teeth n, which first gear meshes with a second gear with the number of teeth 2n on an axle, on which second gear an eccentric device for the dobby movement is arranged, whereby the drive shaft and the first gear are coupleable with each other by means of a wedge radially movably mounted in a radially extending recess in the first gear, which wedge is controlled through a switching member according to said design, and in the coupled condition engages in said radially extending recess of the first gear and in an axially extending groove of the drive shaft, the improvement wherein in the uncoupled condition the wedge is completely uncoupled from the drive shaft, the switching member includes a switching rod, said switching rod being controlled according to the design, said switching rod further includes a coupling member, said wedge is formed with a groove in which said coupling member of said switching rod engages in a coupling range, a rotatably mounted ring having a slot, said wedge has an outer end, said outer end engages in said slot of said ring in the uncoupled condition of the wedge from the drive shaft, an arresting means is disposed on the periphery of the ring, said arresting means for releaseably holding said ring in an operating position.

3. The dobby mechanism according to claim 2, wherein said arresting means comprises a spring-biased, radially moveable blocking wedge.

4. The dobby mechanism according to claim 2, wherein said arresting means comprises an adjustable slipping clutch.

5. The dobby mechanism according to claim 1 or 2, further comprising a stationary guide ring, a peg connected to said guide ring, said switching rod is formed with a longitudinal hole guided on said peg.

6. The dobby mechanism according to claim 1 or 2, wherein said coupling member has ends, said groove of the wedge defines inlets, said ends of the coupling member and the inlets of said groove of the wedge are beveled.

7. The dobby mechanism according to claim 1, wherein said ring is mounted so as to be fixed when said wedge is in the coupled condition with the outer end of said wedge out of engagement from said slot, whereby said overlapping portion of said ring guides said wedge during rotation carried along with said shaft, and said ring is mounted so as to be fixed when said wedge is in the uncoupled condition with said wedge engaged in said slot.

8. The dobby mechanism according to claim 7, wherein said ring is rotatably mounted, overrideable means for fixing said ring in the coupled condition of the wedge when the outer end of the wedge is out of engagement from said slot, as well as respectively, in said uncoupled condition, said overrideable means for releasing said ring such that said ring is rotatably connected with said shaft via said wedge when the latter is both coupled in part in said groove of said shaft and engaged in part in said slot of said ring overriding said overrideable means.

9. A dobby mechanism with a coupling between a drive shaft and a first gear with the number of teeth n, which first gear meshes with a second gear with the number of teeth 2n on an axle, on which second gear an eccentric device for the dobby movement is arranged, whereby the drive shaft and the first gear are coupleable with each other by means of a wedge radially movably mounted in a radially extending recess in the first gear, which wedge is controlled through a switching member according to said design, and in the coupled condition engages in a radially extending recess of the first gear and in an axially extending groove of the drive shaft, the improvement wherein in the uncoupled condition the wedge is completely uncoupled from the drive shaft, the switching member includes a switching rod, said switching rod being controlled according to the design.

said switching rod further includes a coupling member, said wedge is formed with a groove in which said coupling member of said switching rod engages in a coupling range, a resiliently mounted catch, said wedge has an outer end, said outer end engages in said catch in the uncoupled condition.

* * * * *